US005678637A

United States Patent [19]

O'Connell

[11] Patent Number: 5,678,637

[45] Date of Patent: Oct. 21, 1997

[54] FIRE EXTINGUISHING APPARATUS AND METHOD

[76] Inventor: Michael Oliver O'Connell, Knockaneady, Ballineen, County Cork, Ireland

[21] Appl. No.: 545,692

[22] PCT Filed: May 6, 1994

[86] PCT No.: PCT/IE94/00025

§ 371 Date: Feb. 14, 1996

§ 102(e) Date: Feb. 14, 1996

[87] PCT Pub. No.: WO94/26355

PCT Pub. Date: Nov. 24, 1994

[30] Foreign Application Priority Data

| | | | |
|---|---|---|---|
| May 7, 1993 | [IE] | Ireland | 93 0343 |
| Jul. 22, 1993 | [IE] | Ireland | 93 0555 |
| Dec. 22, 1993 | [IE] | Ireland | 93 0992 |

[51] Int. Cl.[6] ..... A62C 35/02

[52] U.S. Cl. ..... 169/46; 169/5; 169/10; 169/37; 239/208; 239/434

[58] Field of Search ..... 169/46, 5, 10, 169/37; 239/208, 434

[56] References Cited

U.S. PATENT DOCUMENTS

| | | | |
|---|---|---|---|
| 822,546 | 6/1906 | Newman | 169/37 |
| 1,370,661 | 3/1921 | Maxwell | 169/10 |
| 1,595,413 | 8/1926 | Meloon | 169/10 |
| 4,417,626 | 11/1983 | Hansen | 169/37 |
| 4,930,579 | 6/1990 | George | 169/54 |
| 4,986,366 | 1/1991 | O'Connell | 169/26 |

FOREIGN PATENT DOCUMENTS

| | | |
|---|---|---|
| 0288164 | 10/1988 | European Pat. Off. . |
| 0314354 | 5/1989 | European Pat. Off. . |
| 2644701 | 9/1990 | France . |

*Primary Examiner*—Gary C. Hoge

*Attorney, Agent, or Firm*—Jacobson, Price, Holman & Stern, PLLC

[57] ABSTRACT

A fire extinguishing apparatus (1) comprising a container (2) for heated water. An outlet (10) for heated water is provided in a manifold (11) which defines an insulating leg for cooler water. A valve (15) is operated to release heated water through the outlet to a discharge head (35). A heating element having an unheated portion (16) in the insulating leg, a high output heating portion (17) and a low output heating portion (18) extends into the container to maintain the heated water at a desired temperature. A pipe (25) extends from an open inlet at a level L in the container to the manifold (11). On operation, a valve (27) on the pipe (25) is opened to release steam from the head space in the container to the discharge head (35). The heated water head (35) breaks up the heated water mass into a micromist of finely dispersed water droplets which forms a highly efficient and safe extinguishant.

40 Claims, 10 Drawing Sheets

FIRE EXTINGUISHING APPARATUS AND METHOD

BACKGROUND OF THE INVENTION

Summary of the Invention

The invention relates to a fire extinguishing apparatus and method.

According to the invention, there is provided a fire extinguishing apparatus comprising:

a container having an outlet for heated water;

heating means for heating to maintain a desired temperature of heated water in the container;

heated water release means for releasing a charge of heated water from the container through the outlet; and a discharge head to break up the heated water mass into an extinguishant comprising a micromist of finely dispersed water droplets on operation of the release means, the discharge head having an inlet for heated water from the container and a discharge outlet.

The invention also provides a discharge head for use in the apparatus and method of the invention, the discharge head having an inlet for heated water, a discharge outlet, and means to break up heated water mass into an extinguishant comprising a micromist of finely dispersed water droplets.

In one embodiment of the invention, the discharge head includes means for generating flash steam and water droplets within the discharge head which forms, on release from the discharge head, a micromist of finely dispersed water droplets.

In one embodiment of the invention the means for generating flash steam and water droplets includes means for injecting steam or gas into the discharge means. Typically the apparatus includes a pipe for leading steam from the container to the discharge head.

In one embodiment of the invention the means for generating flash steam and water droplets includes surface roughening within the discharge head. Preferably the surface roughening is provided adjacent to the inlet to the discharge head.

In a preferred embodiment of the invention the discharge head includes an expansion section downstream and adjacent to the surface roughening.

Preferably the discharge outlet is defined by at least one discharge orifice. Most preferably there are a plurality of discharge orifices in a distributor section of the discharge head.

In one embodiment of the invention the container comprises an inner wall means and an outer wall means which are spaced-apart to define therebetween an insulating space.

Preferably the insulating space is a vacuum space. The insulating space may be filled with an insulating material and/or gas sorbing devices.

In one embodiment of the invention the heated water outlet of the container is provided in an outlet manifold and the heating means is mounted to the manifold. Preferably a steam pipe extends from a steam outlet in the manifold to a steam inlet in the head space of the container. Most preferably the steam pipe inlet is positioned within the container to define a fill level.

In one embodiment of the invention the heating means comprises a heating element having a heated portion and an unheated portion, the unheated portion lying wherein the manifold.

In a preferred arrangement the manifold defines an unheated water leg to insulate the apparatus against heat loss by conduction.

In one embodiment of the invention the heating means comprises a high output element for initial heating and a low output element for maintaining the desired temperature of heated water in the container.

Preferably the apparatus includes mounting means for mounting the apparatus to a fixture.

In a preferred embodiment the apparatus includes a steam outlet and steam release means for releasing steam into the discharge head.

Preferably the heated water release means comprises a valve means which is operated in response to fire conditions to release a charge of heated water into the discharge head.

In a preferred arrangement the steam release means comprises a valve means which is operated in response to fire conditions to release steam into the discharge head.

The container may alternatively or additionally comprise a length of piping or the like.

In one embodiment of the invention the heating means is external of the container. In this case preferably the heating means comprises an external inline heater for water make-up to the container and control means for operating the inline heater to maintain desired operating conditions of heated water in the container.

The invention also provides a method of generating a fire extinguishant comprising the steps of:

heating water in a container;

maintaining a desired temperature of heated water in the container;

releasing a charge of heated water from the container; and breaking up the heated water mass into an extinguishant comprising a micromist of finely dispersed water droplets.

In a preferred embodiment of this aspect of the invention the heated water is broken up by generating flash steam and water droplets which forms, on release from the discharge head, the micromist of finely dispersed water droplets. Most preferably the method includes the step of injecting steam or a gas into the discharge head to break-up the heated water mass.

In an especially preferred arrangement the steam is delivered to the discharge head from a head space in the container of heated water.

BRIEF DESCRIPTION OF THE DRAWINGS

The invention will be more clearly understood from the following description thereof, given by way of example only with reference to the accompanying drawings in which.

DESCRIPTION OF THE PREFERRED EMBODIMENTS

Figure 1:
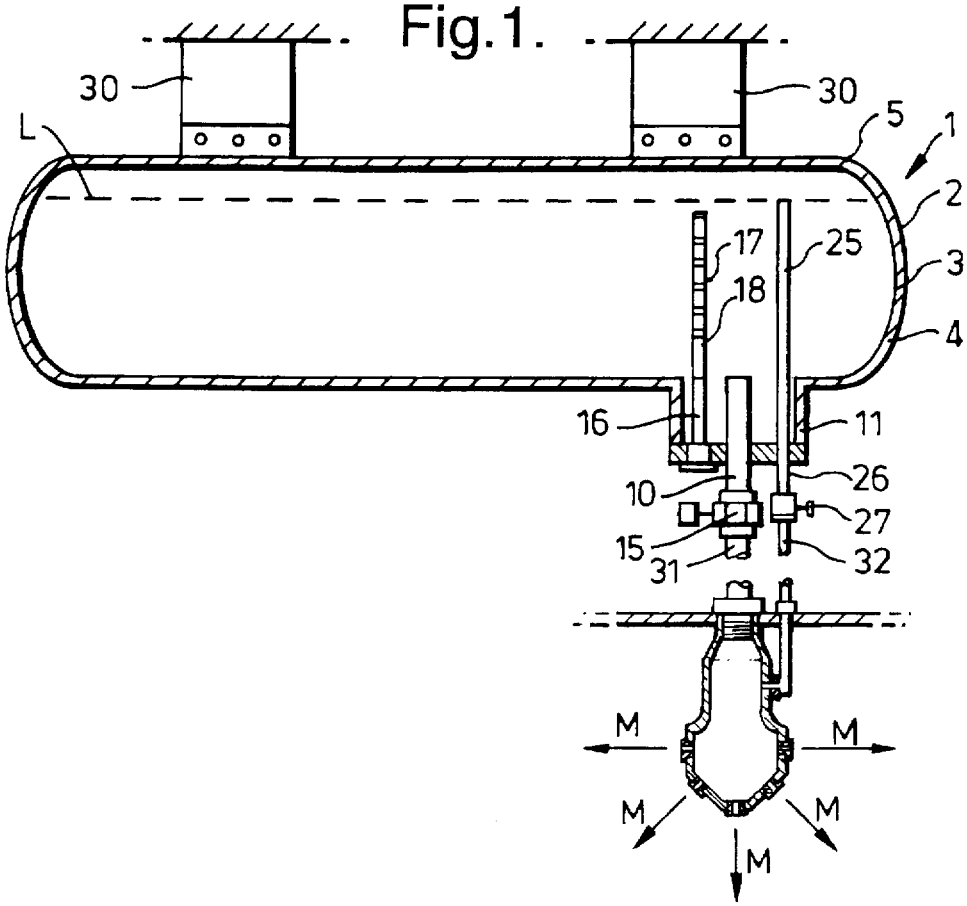
FIG. 1 is a diagrammatic side elevational view of a fire extinguishing apparatus according to the invention in one configuration of use.

Referring to FIG. 1 there is illustrated a fire extinguishing apparatus according to the invention and indicated generally by the reference numeral 1. The apparatus 1 comprises a container 2 for heated water. The container 2 in this case comprises an inner wall 3 and an outer wall 4 which are spaced-apart to define therebetween an insulating space 5 defining a vacuum space. For improved insulation the space 5 is typically filled with an insulation material such as an insulating powder, heat reflecting material and/or stray gas sorbing devices. The surfaces of the walls 3, 4 may also be covered with a reflective insulating liner material (not shown).

An outlet 10 for heated water from the container 2 is provided in an outlet manifold 11. The manifold 11 defines an insulating leg for cooler water as will be described in more detail below. Release means for releasing heated water through the outlet 10 is provided by a valve means such as a solenoid valve 15 with an associated actuator and flow control.

The apparatus includes heating means to maintain a desired temperature of heated water in the container 2. The heating means in this case comprises a heating element having an unheated portion 16 in the insulating leg, a high output heating portion 17 and a low output heating portion 18 in the main body of water in the container 2. The high output portion 17 is used to heat an initial charge of water to a desired temperature. The low output portion 18 is used to maintain the desired temperature over time. The low output portion may be a P.T.C. resistor which combines the technology of electric heating and surface temperature limitation. Such a resistor will ensure automatic temperature limitation at a selected value, independent of the power supply voltage.

It will be noted that the heating means is mounted to the manifold 11.

A pipe 25 is also mounted to the manifold 11 and extends to an open inlet end at a desired level L of heated water in the container 2. Water may be filled into the container 2 to the desired level L by removing a fill/level plug 26 in the pipe 25. In use, as will be described in more detail below, after initial purging, steam is delivered through the pipe 25 from the head space above the water in the container. Release means for releasing steam from the container 2 is provided by a steam valve means, in this case a solenoid valve 27 with an associated actuator and flow control.

For specific designs an alternative fill and level pipe and a separate steam pipe can ensure steam flow with minimum purging. It has been found that the expanded water mass, through heating, does not significantly affect the steam flow vortex.

Mounting means for mounting the apparatus in use is in this case provided by support brackets 30.

Heated water and in this case also steam are delivered, on operation of the extinguishing apparatus by operating the valves 15, 27 respectively. The heated water and steam are delivered into delivery pipes 31, 32 respectively to a discharge head 35 which is shown in detail in FIG. 2.

The discharge head 35 breaks up the heated water mass into an extinguishant comprising a micromist (M) of finely dispersed water droplets. The head 35 has an inlet 36 for heated water (HW) from the container 2 and at least one, and in this case several, discharge outlet orifices 37, at least some of which may have roughened surfaces. In this case the discharge head 35 also includes means for injecting steam or gas into the head 35 which in this case is defined by an inlet 40 for steam (S) from the steam pipe 32. The head includes means for generating flash steam and water droplets within the head which forms, on release through the outlets 37 the micromist of finely dispersed water droplets. In this case the means for generating flash steam and water droplets includes surface roughening, for example defined by a screw thread 41 within the discharge head 35 and in this case adjacent to the inlet 36.

The head 35 includes an expansion section 43 downstream of and adjacent to the surface roughening 41. Steam or gas is introduced into the heated water stream downstream of the expansion section 43 through the inlet 40.

Figure 3:
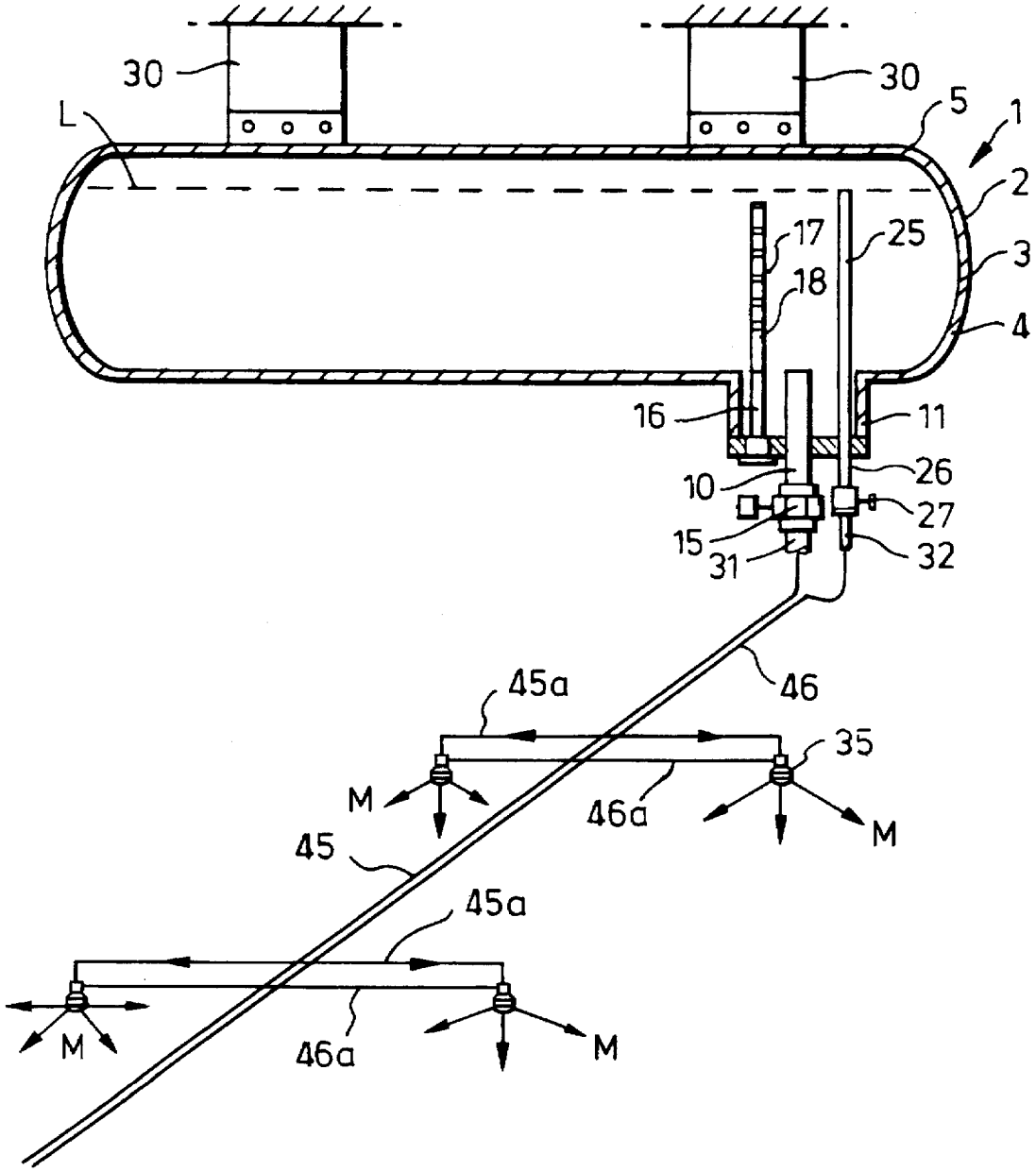
FIGS. 3 and 4 are views of the apparatus of FIG. 1 in further configuration of use.

Referring to FIG. 3 the container 2 is illustrated discharging heated water along a main distribution line 45 including lateral distribution pipes 45*a*, and steam along a main steam line 46 including lateral distribution pipes 46*a* to a number of separate discharge heads 35 suitably positioned to protect a large area.

Figure 4:
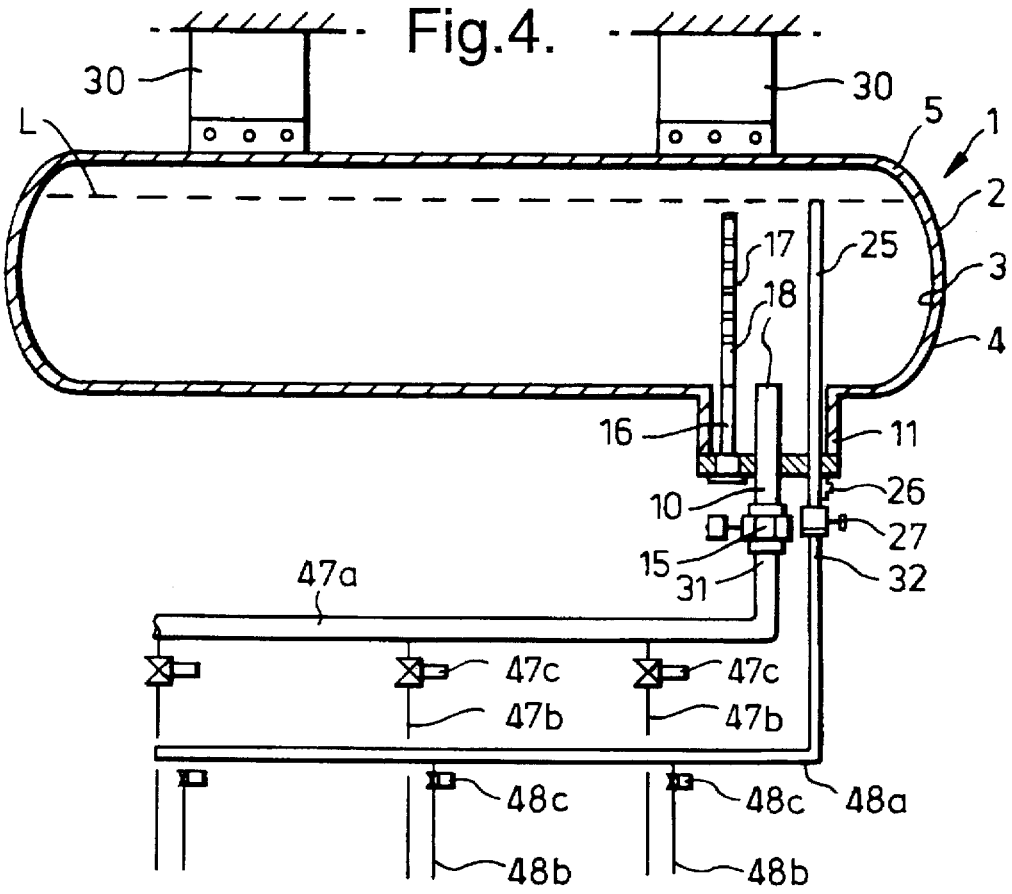

Referring to FIG. 4 the container 2 is illustrated discharging heated water into a main heated water distribution pipe 47 with laterals 47*b* fitted with valves 47*c* and discharging steam into a main steam distribution pipe 48 with laterals 48*b* also fitted with valves 48*c*. The laterals may be associated with various zones, for example in a building. The system allows selected protection of a number of such zoned areas. On detection of a fire in one zone the valves 47*c*, 48*c* associated with that zone are opened to deliver heated water and steam to the discharge heads in that zone.

The invention provides a heated water extinguishing system in which thermal stored energy is such that, on release into an area, complete disintegration of the water will take place. The disintegration is achieved by the formation of vapor bubbles which grow rapidly throughout the mass. When released into an area, the vapor bubbles burst and explode the water into finely dispersed droplets. The vapor bubbles must have sufficient surplus heat energy to continue to grow and fragment the water jet. The vapor bubbles are formed during the boiling process. The steam molecules attach to nuclei, which are present in the water and will remain in suspension throughout the water mass. The release of the heated water and pressure drop will trigger bubble growth. The nuclei or nucleation sites where the steam molecules form and grow can be suspended minute particles, dissolved solids and dissolved gas. The discharging heated water can also influence bubble growth by rough spots on the outlet wall. The presence and density of nucleation sites within the water mass will influence the active steam molecules and bubble density.

It has been found that the injection of steam or possibly gas into the outlet will create and activate any inactive nucleation sites to maximize bubble density.

Rapid vaporization and subsequent cooling instantly reduces the droplet temperature to ambient. The droplets will also continue to reduce further in size, by stripping of surface molecules, producing a micromist (M).

Figure 5:
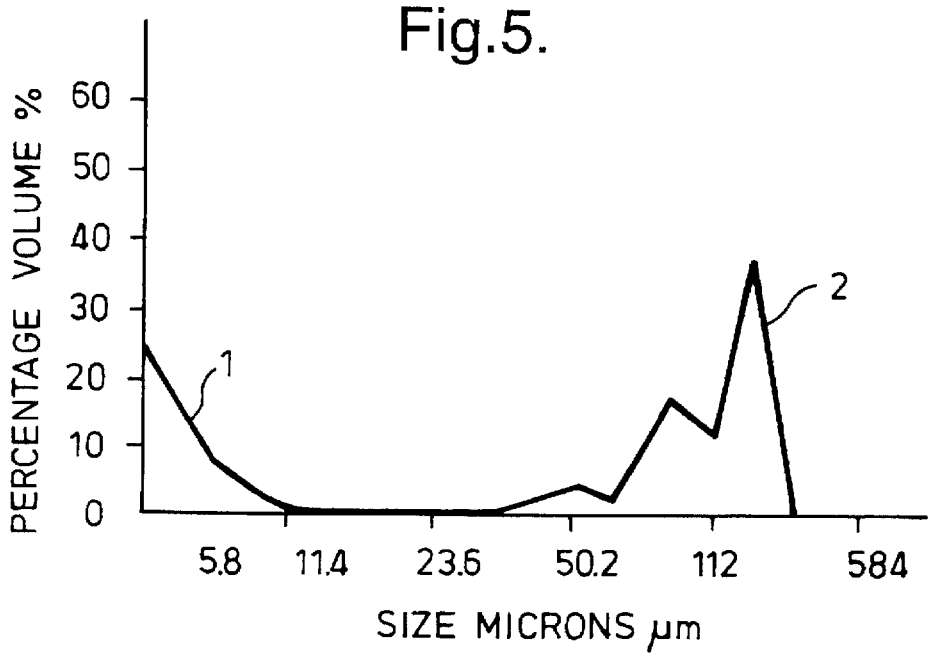
FIG. 5 is a graph of volume distribution of various droplet sizes.

The invention will be clearly understood from the following comments made with particular reference to the droplet distribution curve of FIG. 5.

Table A Shows droplet size measurement, using a laser diffraction sizing method.

TABLE A

| Orifice Size M.M. | Distance from Orifice (m) | Sauter Mean Dia. Hot Water (Microns) | Sauter Cold Water (Microns) |
|---|---|---|---|
| 1 | 2 | 30 | 177 |
| 2 | 1 | 31 | 192 |
| 2 | 2 | 29 | 185 |
| 4 | 2 | 30 | 164 |
| | | 25 Average | 180 Average |

The volume distribution of the various droplets sizes is graphically illustrated in FIG. 5. The curve is typical for 10 Bar 180° C. discharges. Two distinct volume distribution modes exist, one in the larger droplet range at a peak size of 200 microns and the other which peaks with very small droplets less than 5.8 Microns. Volume curve No. 2 in FIG. 5 represents the larger droplets and will be approximately 75% of the liquid volume. Curve No. 1 represents the smaller droplets and is 25% of the liquid volume.

TABLE B

| PRESSURE BAR GAUGE | TEMPERATURE °C. | LIQUID HEAT Kj/Kg | LATENT HEAT Kj/Kg |
|---|---|---|---|
| ZERO BAR | 100° C. | 417.46 Kj/Kg | 2258 Kj/Kg |
| 10 BAR | 184° C. | 781.8 Kj/Kg | 2258 Kj/Kg |

SURPLUS HEAT GAIN = 781.6 − 417.46 = 364.14 Kj/Kg $$\%\ \text{FLASH STEAM} = \frac{364.14 \times 100}{2258} = 16\%$$

Table B illustrates how to calculate the amount of flash steam generated when 10 Bar/180° C. heated water is introduced suddenly back to atmospheric conditions. The heated water mass will regain thermal equilibrium by shedding surplus heat energy as flash steam. The sudden release of energy will disintegrate the water mass and produce the two droplet plumes referred to in FIG. 5. Droplet distribution curve No. 1 is primarily 16% Flash Steam+9% Droplets.

Table C shows the importance of droplet size with settling velocity and suspension times outlined.

TABLE C

| Droplet Diameter Microns | Settling Velocity Meters/Sec. | Suspension Time Seconds per Meter |
|---|---|---|
| 5 | 0.00078 | 1282 Sec |
| 10 | 0.0031 | 322 |
| 15 | 0.007 | 142 |

TABLE C-continued

| Droplet Diameter Microns | Settling Velocity Meters/Sec. | Suspension Time Seconds per Meter |
|---|---|---|
| 20 | 0.012 | 83.3 |
| 30 | 0.028 | 35.7 |
| 50 | 0.078 | 12.8 |
| 100 | 0.31 | 3.2 |

In general, the smaller the droplet size the more effective the droplet is for fire extinguishing. Heat is transferred to a droplet by radiation, conduction and convection. The heat transfer rate is proportional to the droplet volume and the surface area. The smaller the volume, the greater the number of droplets and the greater the surface area exposed. Droplet sizes should preferably be less than 50 microns, and if possible less than 20 microns. The preferred droplet size is one which, when introduced into a flame front, will increase its temperature and absorb full latent heat, i.e. boil and evaporate completely. Large drops of water are ineffective and will extract little or no heat. The ideal droplet will inert an area by water droplet saturation and cooling. Very small droplets will also inert an area by oxygen reduction. For maximum effect the droplets should stay in suspension for a long period. I have found that the water droplet size that will disperse and act as a true agent with inerting and extinguishing by cooling capacity should preferably be less than 20 microns in diameter.

Table D shows the increase in the number of droplets and surface area for different diameters compared to 180 micron droplets of cold water.

TABLE D

| | Diameter (Micron) | (Cu. Micron) | Volume Droplet Numbers | Surface Area Increase |
|---|---|---|---|---|
| Vapour | 10 | 524 | 5830 | 18 |
| Hot Water | 25 | 8182 | 373 | 1.2 |
| Cold Water | 180 | 3,053,600 | 1 | |

Figure 6:
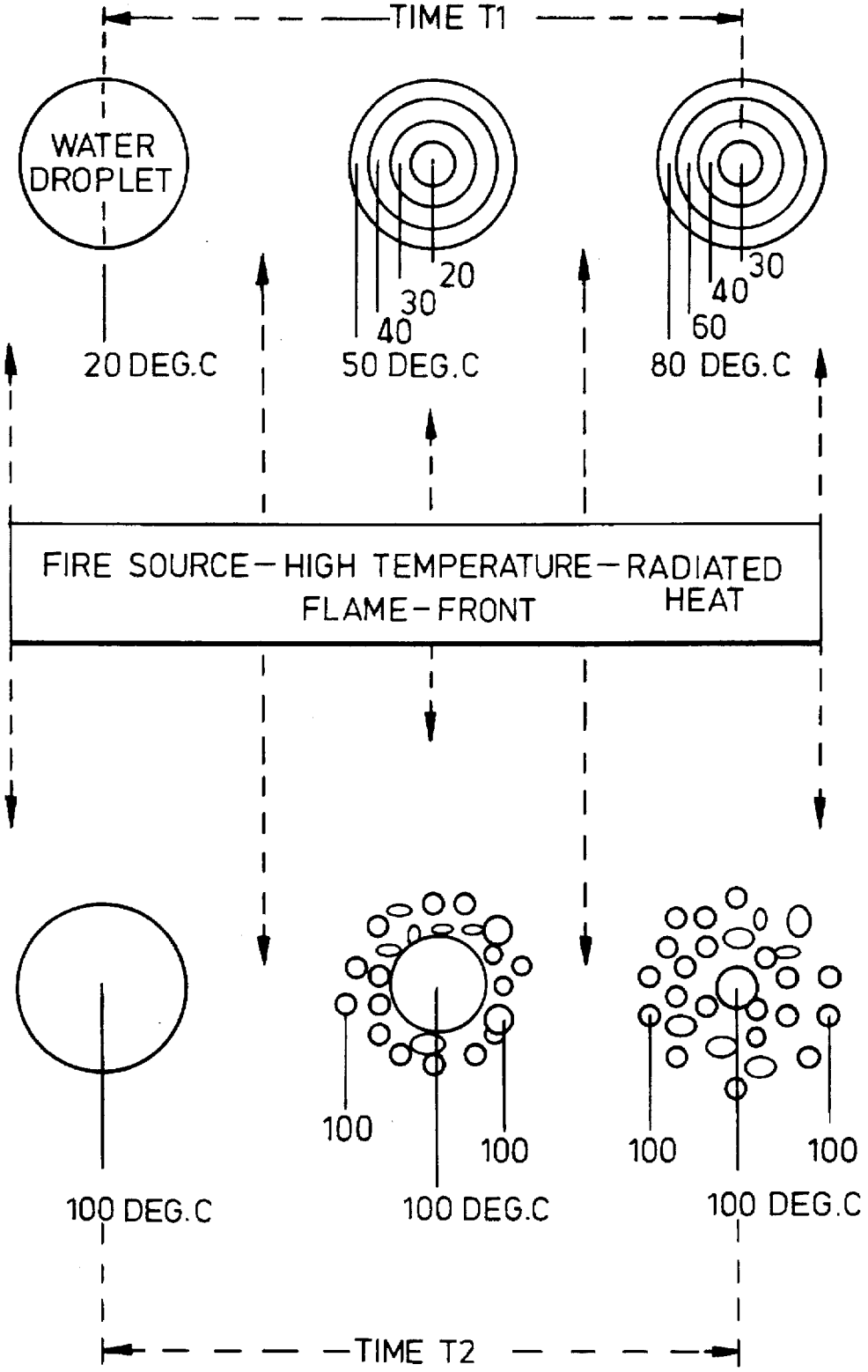
FIG. 6 is a diagram illustrating the operation of the apparatus of the invention.

To assist in understanding the invention and the relevance of heated water droplets compared to cold water droplets reference is now made to the diagram of FIG. 6. The upper part of this diagram illustrates what happens when a cold water droplet at 20° C. is introduced into very hot conditions in which it absorbs liquid heat. It will be noted that the temperature increases gradually from the outside in creating a temperature gradient. Even at very high flame temperatures the droplet may never be vaporized.

The lower part of the diagram of FIG. 6 illustrates by way of contrast what happens in the method and apparatus of the invention when a heated water droplet at 100° C. and ambient pressure conditions is introduced into very hot fire/explosion conditions. The droplet immediately absorbs the heat of vaporization with a consequent decrease in size and an increase in surface area for heat absorbtion. In this condition in the latent heat absorbtion stage at ambient conditions it will accept five times more latent heat than liquid heat.

To vapourize completely a cold water droplet must absorb its liquid heat, boil and evaporate ($T_1$+$T_2$). In contrast, in the invention, the heated water is conditioned to instantly vaporize and strip surface molecules. This reduces the droplet size making it more efficient as an important and rapid absorber of heat (Time<$T_2$).

Referring again to volume curve No. 2 in FIG. 5 it is clear that when considering using water droplets as a substitute for a gaseous agent the 75% of large droplets will be ineffective unless reduced further in size.

The invention effectively reduces the large droplets by employing a method and apparatus to:

(i) generate heated water in a container which is preferably adapted to twin flow of heated water and steam;

(ii) promoting the release of flash steam from the heated water mass;

(iii) promoting the release of flash steam from the heated water mass within the confines of an orifice or nozzle device;

(iv) injecting steam or gas, preferably, from the container head space into a heated water discharge to provide break up and further activation of nuclei not already activated by the boiling process;

(v) the injected steam or gas improves the micromist droplet size when injected within the confines of an orifice or nozzle device.

The following description describes the methods and various devices used to generate the micromist extinguishant. To give effective break up of the larger droplets and increase the droplet plume of 20 microns size it is necessary to induce nucleation and flash steam release as a primary break up mechanism. Further reduction of droplets is enhanced by a combination of expanding flash steam through a suitable nozzle, providing secondary disintegration of the larger droplets.

Nucleation can be encouraged by the provision of primary nozzles. It can also be induced by creating a turbulent exit with baffles or roughening the exit with, for example, a threaded pipe section. In either case, the nucleation should be well established before effective secondary break up with nozzle devices.

The heated water extinguishing units can be adapted to promote twin flow of steam and heated water. The twin flow connected to a suitable two flow nozzle will very effectively break-up the water mass into a micromist of finely dispersed water droplets. In FIG. 1 the head space of the container 2 is communicated to the outlet manifold 11 through an internal pipe 25. For normal operation the head space is charged with steam, however, it can also be charged with a gas such as nitrogen but steam is the preferred option. The steam or gas can flow through the central pipe 25 to the outlet manifold 11. The heated water is also connected to the manifold 11 direct or through an internal pipe. The dual outlets of steam and heated water are connected through suitable valves 15, 27 [manual or automatic] to the discharge head 35.

Figure 7:
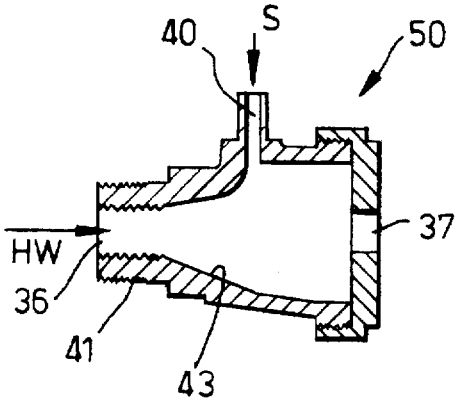
FIG. 7 is a side, partially cross-sectional view of an alternative construction of discharge head.
Figure 8:
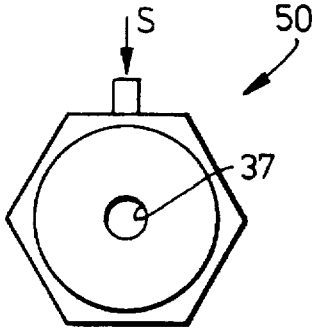
FIG. 8 is an end view of the discharge head of FIG. 7.

The alternative twin flow discharge head 50 shown in FIGS. 7 and 8 has been adapted and tested successfully. The discharge head 50 is similar to the head 35 and like parts are assigned the same reference numerals. The combined flow of steam and heated water is discharged through a single orifice 37 outlet which can be large to accommodate high mass flow. I have established that this orifice discharge assembly will maximize nucleation and bubble growth providing very effective break-up of the water mass. The micromist generated was measured using laser technology which detailed the droplet size distribution.

TABLE E

| ORIFICE | TYPE | D(3.2) | DV(0.5) | DV(0.9) |
|---|---|---|---|---|
| 5 MM | 7D | 2.8 | 3.0 | 4.5 |
| 5 MM | 7D | 3.3 | 3.2 | 196 |
| 5 MM | 7D | 4.9 | 4.3 | 226 |

Note:
1. The large drops DV(0.9) are caused by condensed water accumulating on the equipment and blowing through the laser test beam. It is concluded that a DV(0.9) of 4.5 microns is correct and is confirmed in further tests.
2. The droplet diameters are measured in microns and the diameter notations are as follows:
D(3.2) Sauter Mean Diameter, which is a volume to surface area ratio diameter.
D(0.5) Volume Mean Diameter, value under which 50% of the drops occur.
D(0.9) The value under which 90% of the volume droplets occur.

Table E above gives a summary of test results.

Figure 9A:
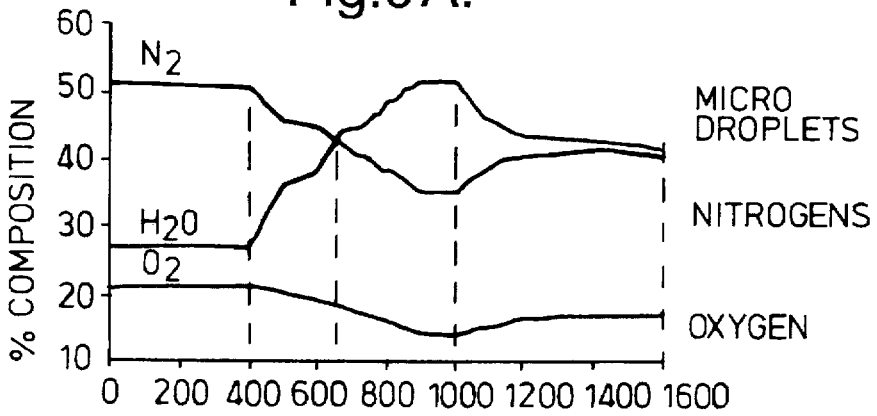
FIG. 9A is a graph of microdroplet saturation, oxygen and nitrogen concentration against time using the apparatus of the invention to extinguish a fire in a room.

An extended study was also performed in a 150 cubic meter test area to determine the combined effects of microdroplet saturation, oxygen reduction, ambient air temperature, water jet temperature, and drop size distribution. Simultaneous readings from mass spectrum gas analysis, interfaced thermistors a Malvern Particle Sizer were recorded. FIG. 9A, Table F, FIG. 9B and Table G gives a set of results based on a heated water discharge of microdroplets at a total flow of 0.3 liters/cubic meter.

Figure 9B:
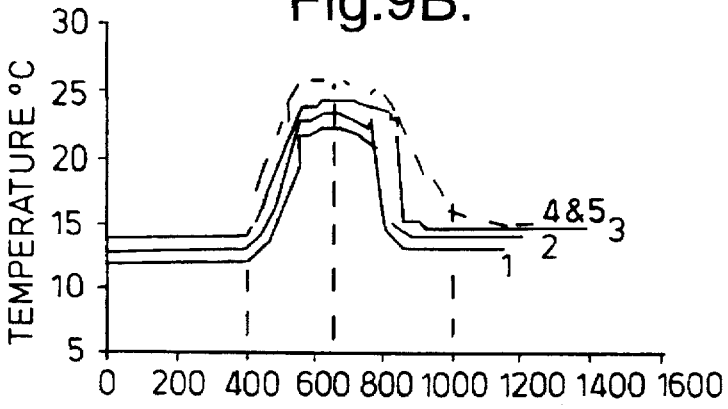
FIG. 9B is a graph of room air temperature against time in the mode of operation of FIG. 9A.

FIG. 9A and FIG. 9B represent the micromist saturation, oxygen reduction and simultaneous ambient air jet temperatures. For FIG. 9B

Thermistor 1 Floor level (12° to 22° C.)

Thermistor 2 Room Center (13° to 23° C.)

Thermistor 3 Ceiling Level (14° to 24° C.)

Thermistor 4 located at center of exit jet at 0.5 meters

Thermistor 5 located at center of exit jet at 2.0 meters

4 and 5 indicated a maximum temperature of 28° C.

The droplet size distribution measured during this test are presented in Table G. The oxygen levels v. time are presented in Table F.

TABLE F

Oxygen levels or time

| Time (secs) | Oxygen Level (%) |
|---|---|
| 400 | 21% |
| 250 | 16% |
| 350 | 14% |
| 600 | 14% to 17% |

TABLE G

Droplet Diameters - Malvern Particle Size

| TIME SEC | D (v,).5) | D (v,0.9) | D (v,0.1) | D (v,4.3) | D (v,3.2) | OBSCURATION |
|---|---|---|---|---|---|---|
| 700 | 3.2 um | 8.0 um | 2.0 um | 28.8 um | 3.2 um | 0.0282 |
| 900 | 4.7 | 412.4 | 2.3 | 107.6 | 4.7 | 0.0153 |
| 1100 | 3.4 | 240 | 2.0 | 58.4 | 3.5 | 0.0292 |

The combined data as tested and presented show conclusively that the discharge head 50 twin flow nozzle of FIGS. 7 and 8 is extremely effective in maximizing nucleation and break up of the water mass. I have established that the heated water extinguishing units according to the invention, adapted for twin flow will generate a micromist that is small enough to remain in suspension for long periods. It will disperse in a similar manner to a gaseous extinguishant but will have unique, superior properties of inerting by micromist saturation, cooling and oxygen reduction.

In more detail FIG. 9A represents the gas analysis of oxygen, water vapor; nitrogen measured using a mass spectrometer. The test area involved a volume of 150 cubic meters. The controlled discharge of heated water extinguishant microdroplet into the area and the effect on oxygen, nitrogen and water vapor are shown.

In more detail, FIG. 9B is a record of the ambient air temperatures during the test. It also gives the microdroplet jet temperature. The test was at the same time. The temperature recordings were measured with free calibrated thermistors connected to a PC and recorded every 6 seconds.

Table G gives the droplet size distribution measurements using a laser particular sizer. The tests were simultaneous to FIG. 9A and FIG. 9B.

Table E gives a cross section of results on droplet size distribution achieved using the twin fluid orifice discharge head 50 of FIGS. 7 and 8. The measurements were recorded at various distances from the orifice and directly in the jet steam.

The combined results verify that in the method and apparatus of the invention the heated water will generate a micromist extinguishant that:

1. will disperse through the protected area;
2. will provide a moderate increase in ambient temperature;
3. will cool instantly;
4. the dispersed droplets will saturate the area and provide:
   a. inerting by microdroplet saturation and cooling;
   b. inerting by oxygen reduction;
5. the droplets are sufficiently small to remain in suspension for long periods;
6. the momentum of the microjet is sufficient through the external release of energy to travel and disperse in excess of 10 meters; and
7. the microdroplet protection is 100% environmentally friendly and safe for use in a manned environment.

Figure 2:
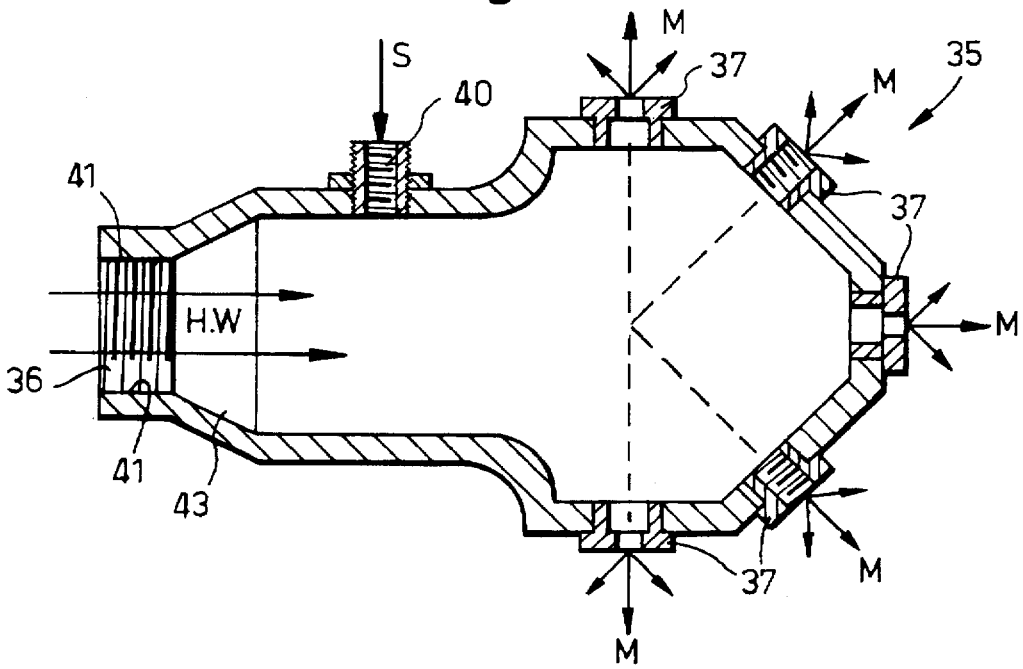
FIG. 2 is a side elevational view of a discharge head forming part of the apparatus of FIG. 1.

In the discharge head 35 of FIGS. 1 and 2 the outlets are removable orifice jets. The unit will operate in a similar manner to that of FIGS. 7 and 8. The mass flow will be increased and the microdroplet spray will be multidirectional. The head 35 is shown with a plain orifice opening and also with a roughened or threaded discharge. The roughened or threaded discharge assists in further break-up. The heated water inlet for the discharge heads 35, 50 can also be roughened or threaded to give advanced nucleation prior to steam injection.

Typical Operating Conditions

The operating temperature, which is controlled automatically, will also determine the operating pressure. The operating mode of the units can be either direct or indirect. On the direct operating mode the units discharge directly as per FIG. 1. In the indirect operations mode the units discharge through distribution pipework as per FIG. 3 and FIG. 4. In all cases the operating temperature and pressure should be sufficient to 1) propel the water mass to the point of use, 2) provide steam for twin flow discharge, 3) retain sufficient energy for flash steam release to disintegrate the water mass.

It has been established that the units will operate through a range of pressures. Testing from 10 bar 180° C. to 1 bar 120° C. produces an effective micromist. The operation is however not limited to this range. To illustrate the operation and energy used Table J shows the related flash steam used for direct and indirect specific use. From Table B and using the example of 10 bar 180° C., it is shown that 16% of the energy will be released at atmospheric. Table J relates this to a typical 50 liter heated water unit which can be used for example to protect an area with microdroplet saturation and applied at a rate of 0.3 Lt/m$^3$. The protected volume can be 150 cubic meters.

It can be seen from Table J that in typical use the driving energy used to propel the water mass is small and the remaining flash steam to disintegrate the water mass is more than 92%.

The 50 Lt. unit referred to in Table J provides a large reservoir of 13552 Lt of potential flash steam. Use can be made of this when considering the protection of sensitive electronic/telecommunications equipment cabinets. The cabinets are often protected by direct injection of an extinguishant. FIG. 4 outlines a system which allows selected protection of different zoned areas within a building. The system can be extended to protect the electronic cabinets by injection of micromist or if preferred by the injection of flash steam. Protecting the cabinets with flash steam, provided from the large reservoir, is an effective simple means which will protect sensitive electronic equipment primarily by oxygen reduction. The injection of steam instead of micromist will also minimize the potential for water damage.

TABLE J

| | | | 16% FLASH STM. | | |
|---|---|---|---|---|---|
| PRESS 10 BAR | TEMP. 180° C. | H.W. VOL. 50 Lt. | 10 BAR 1232 Lt | 8 BAR 1505 lt | 0 BAR 13552 Lt |
| Energy used to propel 50 Lt heated water from the unit at ΔP = 2 Bar | | | 50 Lt. | 450 Lt. | (Approx) |
| Energy used in twin flow at a Max ratio of 1:1 at 8 Bar (Direct operating mode) | | | 50 Lt. | 450 Lt. | (Approx) |
| Energy used in twin flow piped remote to e.g. 100 Meters/12 mm Dia. (Indirect operating mode) | | | 12.6 Lt. | 114 Lt. | (Approx) |
| Remaining energy for disintegratation of the water mass through flash steam release | | | 1405 Lt | 12652 Lt. | |

Figure 10:
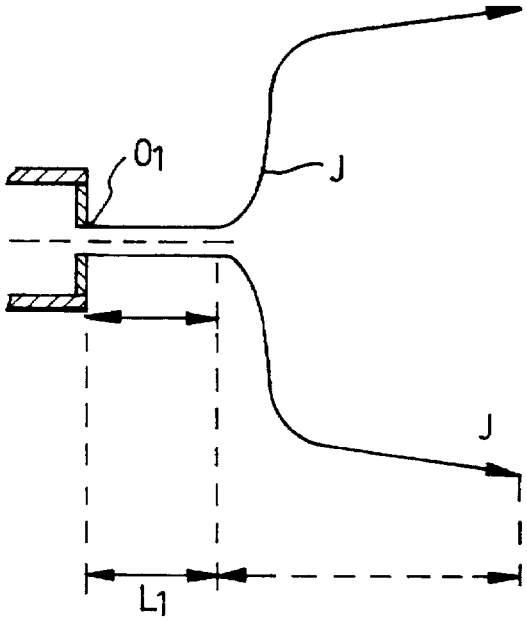
FIGS. 10 and 11 are diagrammatic views illustrating a liquid zone and a flashing zone typical of an orifice discharge.
Figure 12:
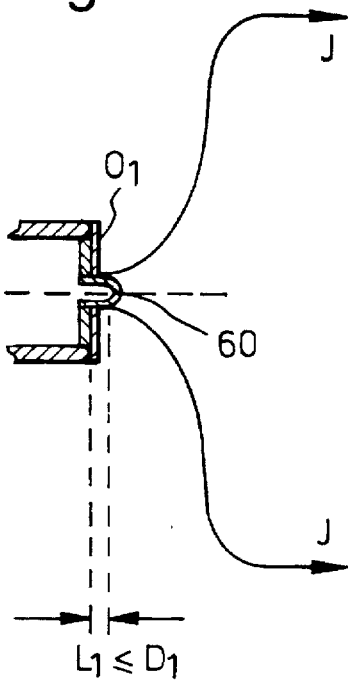
FIGS. 12 and 13 illustrate the fitting of primary nozzles in the liquid zone.
Figure 13:
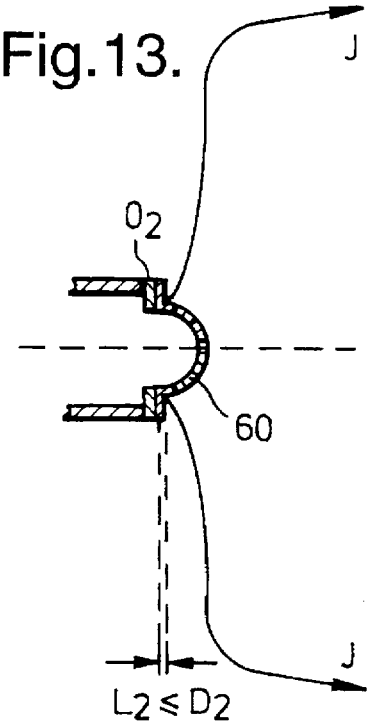
Figure 11:
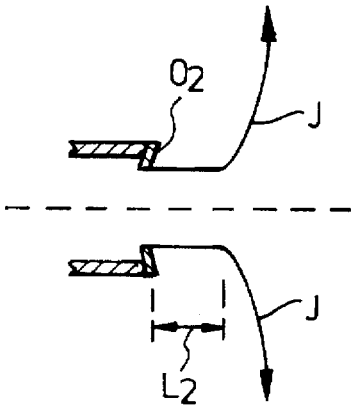

The following description and reference to the drawings will assist in understanding the invention by illustrating:

(i) flashing and disintegration of a plain water jet by the release of flash steam and as represented by the two plume of droplets of FIG. 5 and produced by the device of FIGS. 10 and 11;

(ii) improved break-up and increased small droplet numbers by the use of the devices FIGS. 12 and 13;

(iii) further improved break up and increased numbers of small droplets by the use of extended nozzles and flash steam release inside the nozzle by the use of the devices of FIGS. 15 to 18;

(iv) injected steam into a heated water mass to increase nucleation and bubble density within the water mass. The release of flash steam gives the maximum water break up and finest micromist of droplets. (Refer in particular to FIGS. 2, 7, 8, 19 and 20).

FIG. 10 shows a heated water jet J propelled through an orifice $O_1$. The jet J will remain smooth as a liquid stream for a number of diameters L1 and will disintegrate suddenly in the flashing or nucleation zone. As the orifice size increases to $O_2$ in FIG. 11 the flashing zone will move nearer to the outlet and the liquid zone will reduce to L2 as shown in FIG. 11. The smoother the exit orifice is the longer the length of the liquid zone. The rougher the exit orifice the sooner nucleation begins and the length of the liquid zone decreases.

FIGS. 12 and 13 show the same orifices $O_1$, $O_2$ as illustrated in FIGS. 10 and 11 with a discharge head 60 fitted to the liquid stream in the liquid zones. The effect of discharge head 60 is to mechanically break up the smooth liquid stream which triggers nucleation and flashing of the liquid. Flashing or nucleation is mechanically induced and occurs mostly external to the discharge head 60 and nearer the outlet at reduced L1 and L2.

Figure 14:
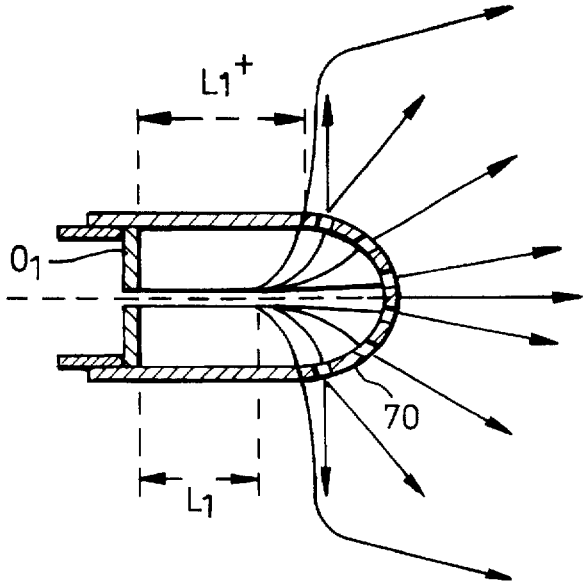
FIGS. 14 and 15 illustrate the fitting of flashing nozzles fitted beyond the liquid zone.
Figure 15:
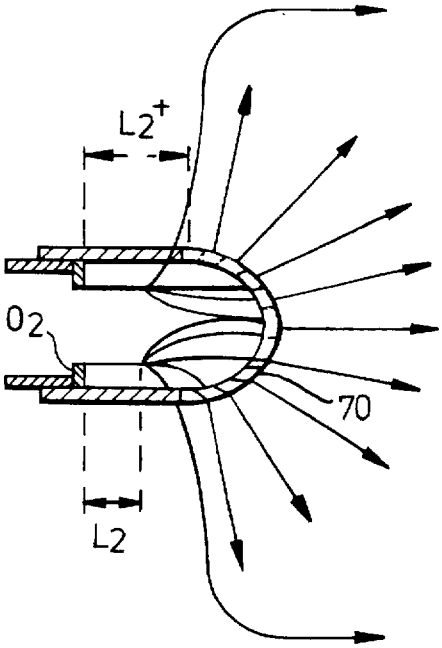

FIG. 14 and FIG. 15 illustrate a hemispherical discharge head 70 fitted at the end of the liquid zone at a distance greater than L1 and L2. The head 70 is ideally placed in the nucleation zone so that flashing and break up will occur inside the hemispherical head 70. The nucleation and formation of droplets inside the head 70 allows the released expanding steam to further disintegrate the droplets through the head 70 and provide a secondary break up. The release of flash steam will activate within the head 70 any nuclei not already activated to maximize steam microbubble saturation. This then maximizes flash steam release and droplets and micromist of reduced size. This will in turn act on the larger droplets described in volume curve No. 2 (FIG. 5) and provide an effective reduction in size to increase the inerting and cooling capacity of the overall droplets.

Figure 16:
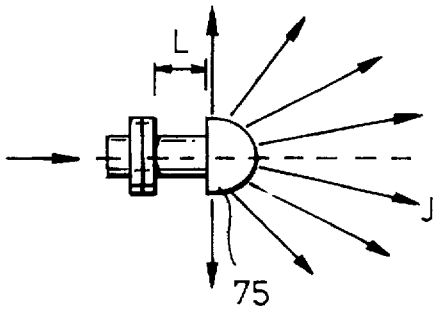
FIGS. 16 and 17 illustrate alternative flashing nozzles similar to the nozzles of FIGS. 14 and 15.
Figure 17:
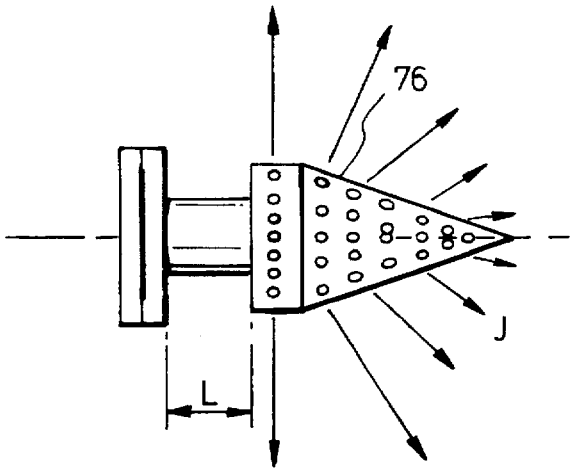

The hemispherical heads 70 illustrated in FIG. 14 and FIG. 15 may also be of the type shown in FIG. 16 and FIG. 17. The discharge heads 75, 76 in both cases are providing greater volume to allow increased flashing to occur within the discharge head.

Figure 18:
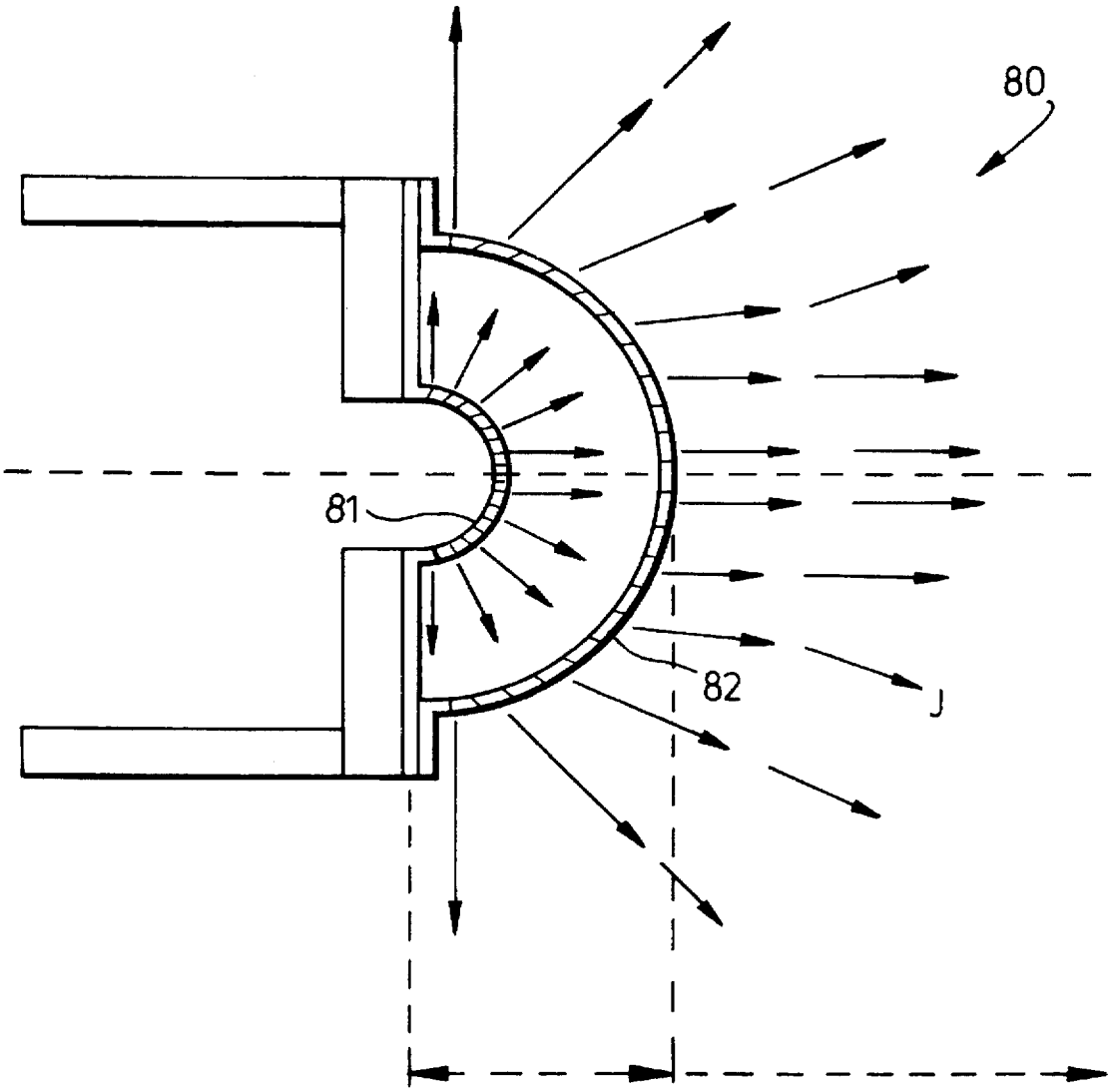
FIG. 18 illustrates a double flashing nozzle.

FIG. 18 illustrates a combination discharge head 80. A primary nozzle 81 triggers flashing and break up of the liquid jet. An outer nozzle 82 takes advantage of the primary disintegration and the released flash steam which provides secondary break up of the larger droplets described in volume curve No. 2 in FIG. 5 above.

The nozzles shown in FIG. 19 and FIG. 20 which are described in more detail below are suitable two phase flow devices and can also be effective.

Referring again to FIG. 5 and the two droplet plumes represented. Tests were conducted to simulate the units represented in FIG. 10, FIG. 11, FIG. 12 and FIG. 13. The results indicate that the droplet sizes can be controlled and a mixture of droplets ranging from 200 microns to the smaller sizes were measured. Further testing showed that the discharge heads of FIGS. 14 to 18 increased the number of smaller droplets and operated in a two phase flow mode and produced a finer distribution similar to the devices of FIG. 2 and FIGS. 7 and 8 and as represented by Table E and Table G.

The nozzle and orifices shown can be used to increase the plume of very small droplets. The heated water units will also operate without the aid of nozzles and orifices and large diameter discharges will disintegrate by the sudden release of energy to provide a droplet distribution ranging from 200 microns to less than 5 microns. This mode of operation will produce large unrestricted mass flow for rapid dispersal.

Preferred twin flow devices of the invention are those illustrated in FIGS. 2 and 7 and 8 and described in detail above. However, it may also be possible to use the twin flow devices illustrated in FIGS. 19 and 20.

Figure 19:
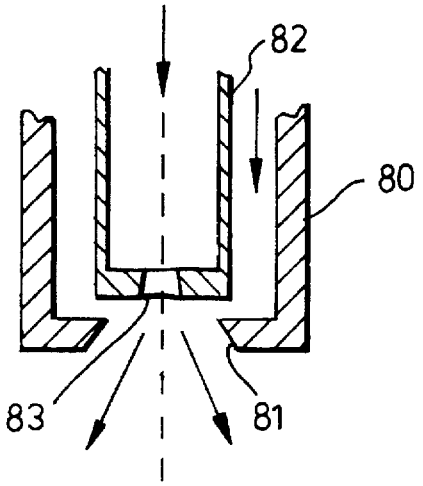
FIGS. 19 and 20 are side, partially cross-sectional views of alternative constructions of discharge heads for use in the apparatus of the invention.

Referring to FIG. 19 there is illustrated a discharge head comprising an outer body 80 having an outer nozzle 81 and an inner body 82 having an inner nozzle 83 which discharges into the outer nozzle 81. Pressurized hot water is delivered to the inner nozzle 83 and cold or tempered water being delivered to the outer nozzle 81, the pressurized hot water supplying the atomizing energy to provide a jet of combined diffused water droplets which act as an effective fire extinguishing medium.

Figure 20:
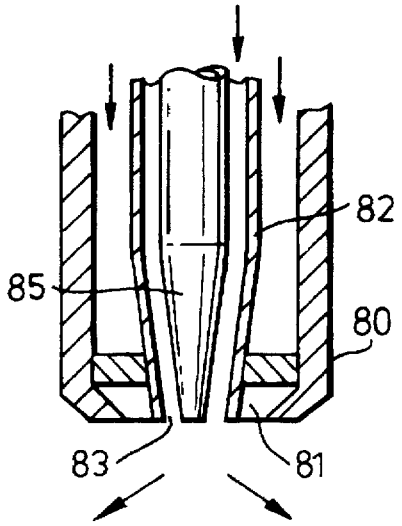

Referring to FIG. 20, there is illustrated another nozzle based fire extinguishing system which is similar to the arrangement of FIG. 19, and like parts are assigned the same reference numerals. In this case, the pressurized hot water is discharged through an outer nozzle 81 and adjustment means in the form of a needle valve 85 is used to regulate the throughput and spray angle at the nozzle outlet to provide a jet of combined diffused water droplets.

Figure 21:
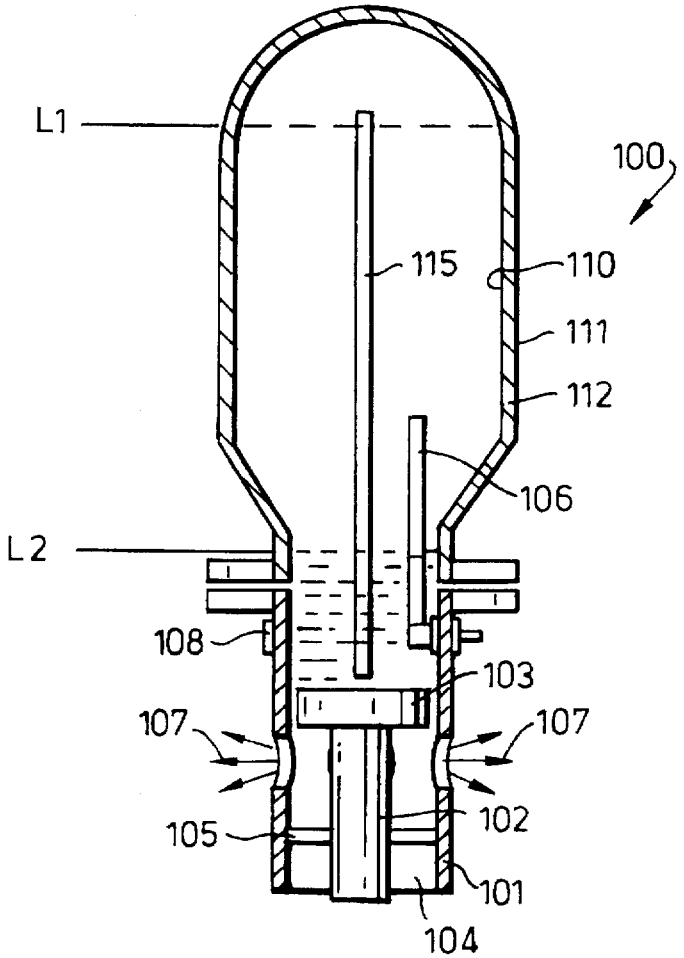
FIG. 21 is a side, partially cross-sectional view of another fire extinguishing apparatus according to the invention.

Referring to FIG. 21 there is illustrated a vertically mounted extinguisher unit 100 comprising a manifold assembly 101 having an outlet valve 103 including a spindle 102, a spindle guide and locking mechanism 104 and a shock absorber pad 105. The unit 101 includes an inlet fill port 108 and outlet ports 107 closed by the valve 103. A heating element 106 extends into the extinguisher unit to heat the water. Heated water is at a typical level $L_1$ and a cold water is typically present to the top of a layer $L_2$. The container of the unit 100 includes an inner wall 110 typically of stainless steel and an outer wall 111 of steel or other suitable material which are spaced-apart to define a vacuum insulating space 112 therebetween.

The cold water layer acts as an insulation between the heated water and the piston valve 103. The cold layer prevents heat losses by conductance to the cylinder, valve and heating element. The vacuum walled container reduces to a minimum the conduction, convection and radiation losses. The release ports 107 are designed to give a horizontal throw of extinguishant which will gravity settle into a protected area. The hole size 107 can be drilled to any diameter and can be used to provide distribution and further break up of the water droplets.

Steam is delivered from the head space in the container to the outlet by a steam pipe 115 which extends from the head space to the outlet.

On operation, the outlet valve 103 or piston is released in the event of fire conditions and the piston is driven downwardly by the water mass to expose the outlet parts 107. Steam is delivered to the outlets 107 by the pipe 115 to activate dormant nuclei in the water mass to maximize bubble growth and to generate a micromist extinguishant.

Figure 22:
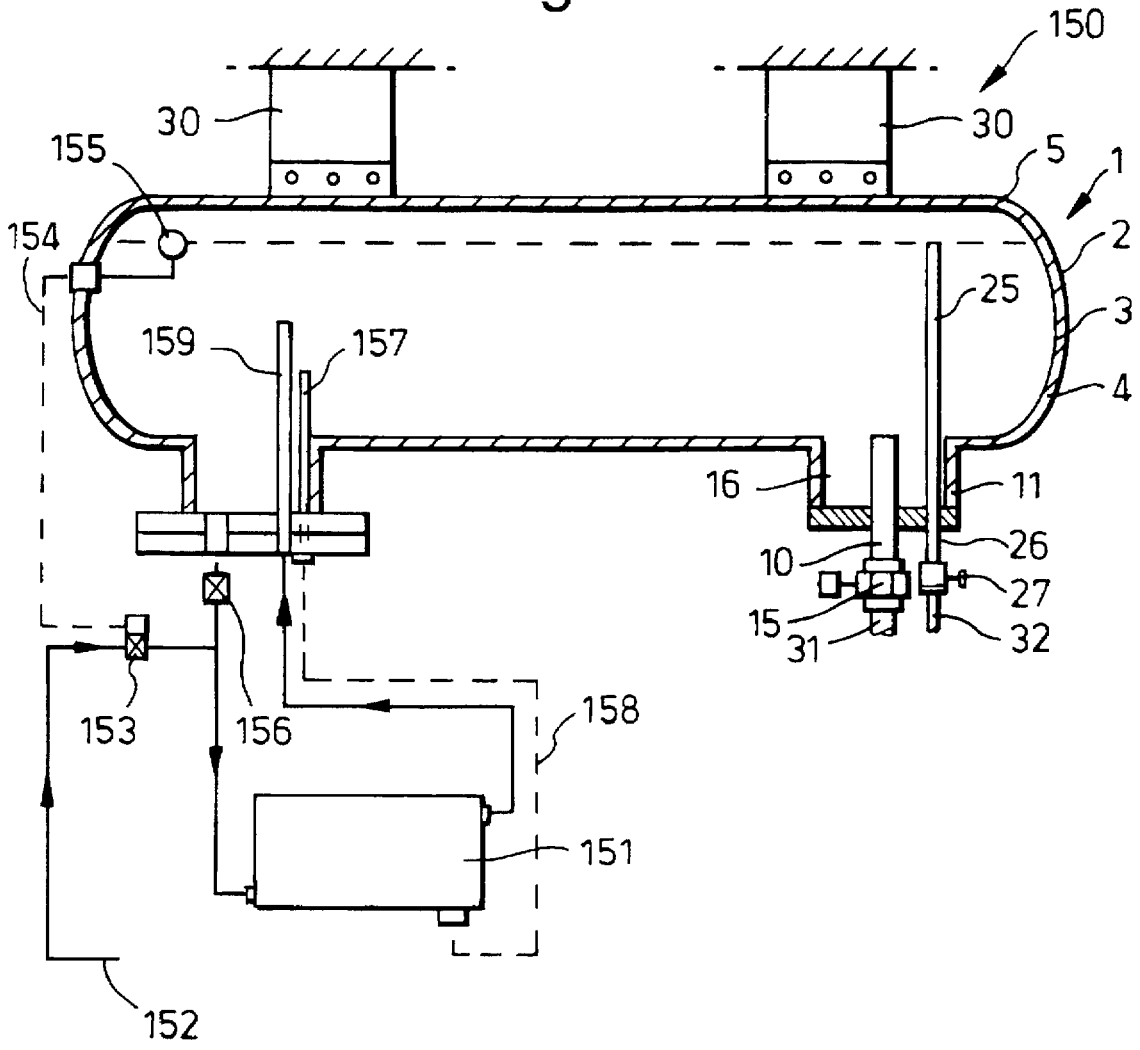
FIG. 22 is a diagrammatic side elevational view of another fire extinguishing apparatus.

Referring to FIG. 22 there is illustrated another fire extinguishing unit 150 according to the invention. The unit 150 is similar to that described above with reference to FIGS. 1 to 4 and like parts are assigned the same reference numerals. In this case the water in the container 2 is heated by an external heating source which may be provided by an inline heater 151. Make-up water is provided from a supply 152 through an automatic make-up valve 153 operated by a control loop 154 on a signal from a level switch 155 on the level of water in the container 2. A non-return valve 156 ensures that the make-up water is heated by the heater 151 prior to delivery through an inlet pipe section 159. A thermocouple 157 monitors the temperature of the water in the container 2 and causes the inline heater 151 to operate on a control loop 158.

In use, the float 155 will detect a drop in water level in the container 2 and open the inlet water valve 153. All make-up water travels through the inline heater 151 and inlet pipe 159. The level float switch 155 closes the automatic make-up valve 153 when a desired level has been achieved. Operating conditions are maintained by the thermostatic control loop 158.

It will be appreciated that such extinguishing units may be opened automatically using a solenoid operated release mechanism and/or using pyrotechnic firing devices for rapid release in response to fire or explosion conditions.

It will be appreciated that in certain cases additives may be required which will improve performance. These additives may include additions which:

a) increase the nuclei or nucleation sites and improve the active bubble density;

b) improve the boiling heat flux (Q/A) such as wetting agents/detergents;

c) reduce surface tension and improve boiling such as wetting agent/detergents;

The water referred to is normally meant to be normal domestic water. The invention is not so limited however and water such as distilled water, deionized water, demineralized water, salt water, water with additives etc. can equally be effective for particular design applications.

It will also appreciated that the container for heated water may be provided by a pipe or the like. The heating means for maintaining a desired temperature of heated water in the container may also be provided by an external heating means such as by trace heating of the container.

These and many other changes and modifications will be readily apparent and accordingly the invention is not limited to the embodiments hereinbefore described which may be varied in both construction and detail.

I claim:

1. A fire extinguishing apparatus comprising:

a container having an outlet;

heating means for heating water in the container;

heated water release means for releasing a charge of heated water from the outlet of said container; and a discharge head into which the heated water is released from the outlet of the container;

the discharge head having an inlet for heated water from the container, a discharge outlet, and means to break up the heated water mass including means for generating flash steam and water droplets within the discharge head such that the flash steam and water droplets form, on release from the discharge outlet, an extinguishant comprising a micromist of finely dispersed water droplets on operation of the release means.

2. The apparatus as claimed in claim 1 wherein the means for generating flash steam and water droplets includes means for injecting steam or gas into the discharge head.

3. The apparatus as claimed in claim 2 wherein the apparatus includes a pipe for leading steam from the container to the discharge head.

4. The apparatus as claimed in claim 1 wherein the means for generating flash steam and water droplets includes surface roughening within the discharge head.

5. The apparatus as claimed in claim 4 wherein the surface roughening is provided adjacent to the inlet to the discharge head.

6. The apparatus as claimed in claim 5 wherein the discharge head includes an expansion section downstream and adjacent to the surface roughening.

7. The apparatus as claimed in claim 1 wherein the discharge outlet is defined by at least one discharge orifice.

8. The apparatus as claimed in claim 7 wherein said at least one discharge orifice comprises a plurality of discharge orifices in a distributor section of the discharge head.

9. The apparatus as claimed in claim 1 wherein the container comprises an inner wall means and an outer wall means which are spaced-apart to define therebetween an insulating space.

10. The apparatus as claimed in claim 9 wherein the insulating space is a vacuum space.

11. The apparatus as claimed in claim 10 wherein the insulating space is filled with an insulating material.

12. The apparatus as claimed in claim 1 wherein the outlet of the container is provided in an outlet manifold and the heating means is mounted to the manifold.

13. The apparatus as claimed in claim 12 wherein a steam pipe extends from a steam outlet in the manifold to a steam inlet in a head space of the container.

14. The apparatus as claimed in claim 13 wherein the steam pipe includes an inlet positioned within the container to define a fill level.

15. The apparatus as claimed in claim 12 wherein the heating means comprises a heating element having a heated portion and an unheated portion, the unheated portion lying within the manifold.

16. The apparatus as claimed in claim 12 wherein the manifold defines an unheated water leg to insulate the apparatus against heat loss by conduction.

17. The apparatus as claimed in claim 1 wherein the heating means comprises a high output element for initial heating and a low output element for maintaining a desired temperature of heated water in the container.

18. The apparatus as claimed in claim 1 including mounting means for mounting the apparatus to a fixture.

19. The apparatus as claimed in claim 1 wherein the apparatus includes a steam outlet and steam release means for releasing steam into the discharge head.

20. The apparatus as claimed in claim 1 wherein the heated water release means comprises a valve means which is operated in response to fire conditions to release a charge of heated water into the discharge head.

21. The apparatus as claimed in claim 20 wherein the steam release means comprises a valve means which is operated in response to fire conditions to release steam into the discharge head.

22. The apparatus as claimed in claim 1 wherein the heating means is external of the container.

23. The apparatus as claimed in claim 22 wherein the heating means comprises an external inline heater for water make-up to the container and control means for operating the inline heater to maintain desired operating conditions of heated water in the container.

24. A method of generating a fire extinguishant comprising the steps of:

heating water in a container having an outlet for heated water;

maintaining a desired temperature of heated water in the container using a heating means;

releasing a charge of heated water from the outlet of the container into a discharge head by operating a heated water release means; and breaking up the heated water mass by generating flash steam and water droplets in the discharge head, the flash steam and water droplets forming, on release from a discharge outlet of the discharge head, a micromist of finely dispersed water droplets.

25. The method as claimed in claim 24 including the step of injecting a gas into the discharge head.

26. The method as claimed in claim 24 including the step of injecting steam into the discharge head.

27. The method as claimed in claim 24 wherein the steam is delivered to the discharge head from a head space in the container of heated water.

28. A discharge head for use in a fire extinguishing apparatus, the discharge head having an inlet for heated water, a discharge outlet, and means to break up heated water mass including means for generating flash steam and water droplets within the discharge head such that the flash steam and water droplets form, on release from the discharge outlet of the discharge head, a micromist of finely dispersed water droplets.

29. A fire extinguishing apparatus comprising:

a container having an outlet for heated water;

heating means for heating to maintain a desired temperature of heated water in the container;

heated water release means for releasing a charge of heated water from the container through the outlet; and a discharge head to break up the heated water mass into an extinguishant comprising a micromist of finely dispersed water droplets on operation of the release means, the discharge head having an inlet for heated water from the container and a discharge outlet, wherein the discharge head includes means for generating flash steam and water droplets within the discharge head which forms, on release from the discharge head, a micromist of finely dispersed water droplets, wherein the means for generating flash steam and water droplets includes means for injecting steam or gas into the discharge head, and wherein the apparatus includes a pipe for leading steam from the container to the discharge head.

30. A fire extinguishing apparatus comprising:

a container having an outlet for heated water;

heating means for heating to maintain a desired temperature of heated water in the container;

heated water release means for releasing a charge of heated water from the container through the outlet; and a discharge head to break up the heated water mass into an extinguishant comprising a micromist of finely dispersed water droplets on operation of the release means, the discharge head having an inlet for heated water from the container and a discharge outlet, wherein the discharge head includes means for generating flash steam and water droplets within the discharge head which forms, on release from the discharge head, a micromist of finely dispersed water droplets, and wherein the means for generating flash steam and water droplets includes surface roughening within the discharge head.

31. A fire extinguishing apparatus comprising:

a container having an outlet for heated water;

heating means for heating to maintain a desired temperature of heated water in the container;

heated water release means for releasing a charge of heated water from the container through the outlet; and a discharge head to break up the heated water mass into an extinguishant comprising a micromist of finely dispersed water droplets on operation of the release means, the discharge head having an inlet for heated water from the container and a discharge outlet, wherein the outlet of the container is provided with an outlet manifold and the heating means is mounted to the manifold.

32. The apparatus of claim 31 wherein a steam pipe extends from a steam outlet in the manifold to a steam inlet in a head space of the container.

33. The apparatus of claim 32, wherein the steam pipe includes an inlet positioned within the container to define a fill level.

34. The apparatus of claim 31, wherein the heating means comprises a heating element having a heated portion and an unheated portion, the unheated portion lying within the manifold.

35. The apparatus of claim 31, wherein the manifold defines an unheated water leg to insulate the apparatus against heat loss by conduction.

36. A fire extinguishing apparatus comprising:

a container having an outlet for heated water;

heating means for heating to maintain a desired temperature of heated water in the container;

heated water release means for releasing a charge of heated water from the container through the outlet; and a discharge head to break up the heated water mass into an extinguishant comprising a micromist of finely dispersed water droplets on operation of the release means, the discharge head having an inlet for heated water from the container and a discharge outlet, wherein the heating means comprises a high output element for initial heating and a low output element for maintaining the desired temperature of heated water in the container.

37. A fire extinguishing apparatus comprising:

a container having an outlet for heated water;

heating means for heating to maintain a desired temperature of heated water in the container;

heated water release means for releasing a charge of heated water from the container through the outlet; and a discharge head to break up the heated water mass into an extinguishant comprising a micromist of finely dispersed water droplets on operation of the release means, the discharge head having an inlet for heated water from the container and a discharge outlet, wherein the apparatus includes a steam outlet and steam release means for releasing steam into the discharge head.

38. The apparatus of claim 37, wherein the steam release means comprises a valve means which is operated in response to fire conditions to release steam into the discharge head.

39. A method of generating a fire extinguishant comprising the steps of:

heating water in a container;

maintaining a desired temperature of heated water in the container;

releasing a charge of heated water from the container;

breaking up the heated water mass into an extinguishant comprising a micromist of finely dispersed water droplets, and injecting steam or a gas into the discharge head to break-up the heated water mass.

40. The method of claim 39, wherein the steam is delivered to the discharge head from a head space in the container of heated water.

* * * * *